US006286673B1

(12) United States Patent
Robertson

(10) Patent No.: US 6,286,673 B1
(45) Date of Patent: Sep. 11, 2001

(54) CONVERTIBLE CARRIER FOR GOLF CLUBS

(76) Inventor: David M. Robertson, 2213 M. Lake Park Dr., Smyrna, GA (US) 30080

( * ) Notice: Subject to any disclaimer, the term of this patent is extended or adjusted under 35 U.S.C. 154(b) by 0 days.

(21) Appl. No.: 09/494,805

(22) Filed: Jan. 31, 2000

Related U.S. Application Data

(60) Provisional application No. 60/118,167, filed on Feb. 1, 1999.

(51) Int. Cl.[7] ..... A63B 55/00

(52) U.S. Cl. ..... 206/315.3; 206/315.4; 206/315.5; 206/315.6

(58) Field of Search ..... 206/315.2–315.6

(56) References Cited

U.S. PATENT DOCUMENTS

| | | | | |
|---|---|---|---|---|
| 1,437,349 | * | 11/1922 | Moore, Jr. | 206/315.6 |
| 1,442,906 | * | 1/1923 | Rawlings et al. | 206/315.6 X |
| 2,009,072 | * | 7/1935 | Samoson | 206/315.6 X |
| 2,010,166 | * | 8/1935 | Thompson | 206/315.6 |
| 2,023,792 | * | 12/1935 | Sampson | 206/315.4 |
| 3,985,229 | * | 10/1976 | Maki | 206/315.6 |
| 4,227,559 | * | 10/1980 | Stroman | 206/315.6 |
| 4,266,589 | | 5/1981 | Cochran . | |
| 4,334,564 | * | 6/1982 | Clayton | 206/315.6 |
| 4,420,024 | * | 12/1983 | Clayton | 206/315.6 X |
| 4,509,643 | | 4/1985 | Rhee | 206/315.6 X |
| 4,664,382 | * | 5/1987 | Palmer et al. | 206/315.6 X |
| 4,967,904 | | 11/1990 | Quellais et al. | 206/315.6 X |
| 5,333,731 | | 8/1994 | McCuaig | 206/315.6 X |
| 5,465,839 | | 11/1995 | Gretz | 206/315.6 X |
| 5,551,561 | | 9/1996 | MacRae et al. | 206/315.6 X |
| 5,816,396 | * | 10/1998 | Shin | 206/315.2 X |

* cited by examiner

*Primary Examiner*—Sue A. Weaver
(74) *Attorney, Agent, or Firm*—Baker, Donelson, Bearman & Caldwell

(57) ABSTRACT

A convertible carrier for golf clubs in which the carrier comprises a base member having a top portion, an elongated middle portion and a bottom portion; and a plurality of discrete elongated tubular members attached to the base member in a spaced apart relationship; wherein the carrier can be closed.

12 Claims, 2 Drawing Sheets

CONVERTIBLE CARRIER FOR GOLF CLUBS

This application claims the benefit of U.S. Provisional Application Ser. No. 60/118,167, filed Feb. 1, 1999.

TECHNICAL FIELD

This invention relates to a carrier for golf clubs. In a more specific aspect, this invention relates to a convertible carrier for golf clubs.

BACKGROUND OF THE INVENTION

In the "on-the-go" lifestyle of today, convenience and effective use of available space are common demands and expectations of consumers. This fact is certainly true with regard to golf, a sport which is enjoying an increase in popularity, especially in regard to vacations and the business world. As families and business people travel to meetings, vacations, conferences, etc., the recreation portion of those events frequently includes golf, which may necessitate traveling with golf clubs and a golf bag.

Whether travel is by ground or air, the traditional golf bag is bulky and difficult to transport. Storing a golf bag in a car trunk results in limited space for other items. Further, if more than one golf bag is stored in a car trunk, other items such as luggage and briefcases may need to be placed in the back seat area of the car, an area visible to potential thieves.

In similar fashion when air travel is involved, the traditional bulky golf bag can make the check-in and baggage claim procedures to be more difficult steps.

The prior art contains several attempts to provide a more useful and transportable golfbag. For example, U.S. Pat. No. 4,266,589 discloses a lightweight carrier for golf clubs, and U.S. Pat. No. 4,509,643 discloses a golf bag with a reinforcing insert tube.

Other golf bags or cases which can be used during travel are disclosed in U.S. Pat. Nos. 4,967,904; 5,333,731 and 5,465,839. Additionally, a convertible carrier for golf equipment is disclosed in U.S. Pat. No. 5,551,561.

However, the golf club carriers, bags and cases of the prior art do not provide the features and advantages which are needed for today's lifestyle. Therefore, a need continues to exist for a convertible carrier for golf clubs.

SUMMARY OF THE INVENTION

Briefly described, the present invention provides a convertible carrier for golf clubs. The carrier of this invention is lightweight and will accommodate a plurality of golf clubs. Additionally, the carrier of this invention is less bulky than the traditional golf bag.

Accordingly, an object of this invention is to provide a carrier for golf clubs.

Another object of this invention is to provide a convertible carrier for golf clubs.

Another object of this invention is to provide a convertible carrier for transporting golf clubs.

Another object of this invention is to provide a lightweight convertible carrier for golf clubs.

Another object of this invention is to provide a lightweight convertible carrier for golf clubs which is less bulky than a traditional golf bag.

Still another object of this invention is to provide a carrier for golf clubs which can be easily handled in travel situations.

Still another object of this invention is to provide a carrier for golf clubs which can be easily converted from a golf club carrier for playing golf to a golf club carrier for traveling.

Still another object of this invention is to provide a carrier for golf clubs which lays substantially flat for traveling.

These and other objects, features and advantages of this invention will become apparent from the following detailed description.

DETAILED DESCRIPTION OF THE INVENTION

The present invention provides a convertible carrier for golf clubs in which the carrier comprises (A) a base member having a top portion, an elongated middle portion and a bottom portion; (B) a plurality of discrete elongated tubular members, each member having top, middle and bottom portions and (C) closing means attached to the base member.

In the carrier of this invention, each tubular member has an open top portion and a closed bottom portion, and the length of each tubular member is substantially equal to the length of the base member.

Additionally, the tubular members are attached to the base member at intervals so that the tubular members are spaced apart from each other. This spacing allows the carrier to be closed into a substantially tubular form or bundle for traveling, etc. When not closed or otherwise "rolled up", the carrier can lay in a substantially flat open position.

The tubular members can be attached to the base member by any suitable means of attachment, examples of which include a sewn attachment, a hook-and-loop attachment, etc.

Figure 1:
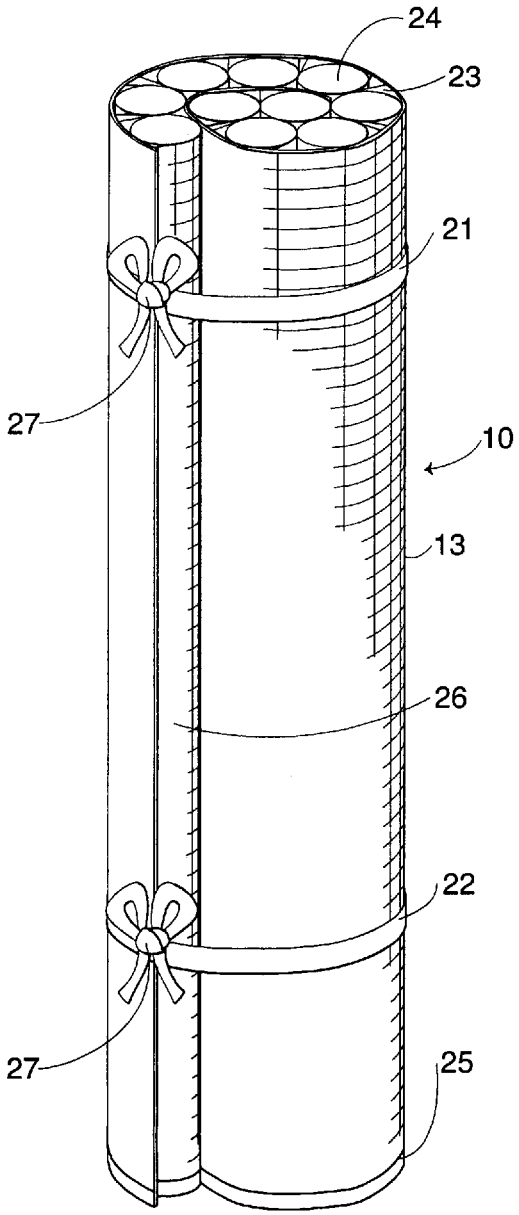
FIG. 1 is a front view of the convertible carrier of this invention, shown in a closed position.

Referring now to the drawings, with like numbers representing like elements, FIG. 1 shows a preferred embodiment of this invention in which the convertible carrier 10 comprises a base member 18, discrete elongated tubular members 23 containing rigid structural tubular liners 24. Closing means 21–21' and 22–22' are shown at the top and bottom portions, respectively, of the base member 18. Closure of the closing means is shown at 27 (top) and 27' (bottom) where the ends of base member 18 are joined at seam 26. The discrete elongated tubular members 23 have open top portions and closed bottom portions generally shown at 25.

The closing means 21–21' and 22–22' are shown in FIG. 1 as straps which tie to close. Other closing means can be used in this invention, such as straps with hook-and-loop closures, buckles, zippers, snaps, clamps, clasps, etc.

For structured integrity and greater protection of the golf clubs (i.e., the grips, shafts and heads), a rigid tubular liner 24 (e.g., rigid vinyl or similar material) is preferably inserted into each discrete elongated tubular member 23.

The base member 18 and the tubular members 23 can be made of a cloth fabric, ballistic nylon or similar material. Preferably, the base member 18 is made from a waterproof or water-resistant material which will provide good protection for the contents of the carrier 10 from the weather and from wear and tear.

Figure 2:
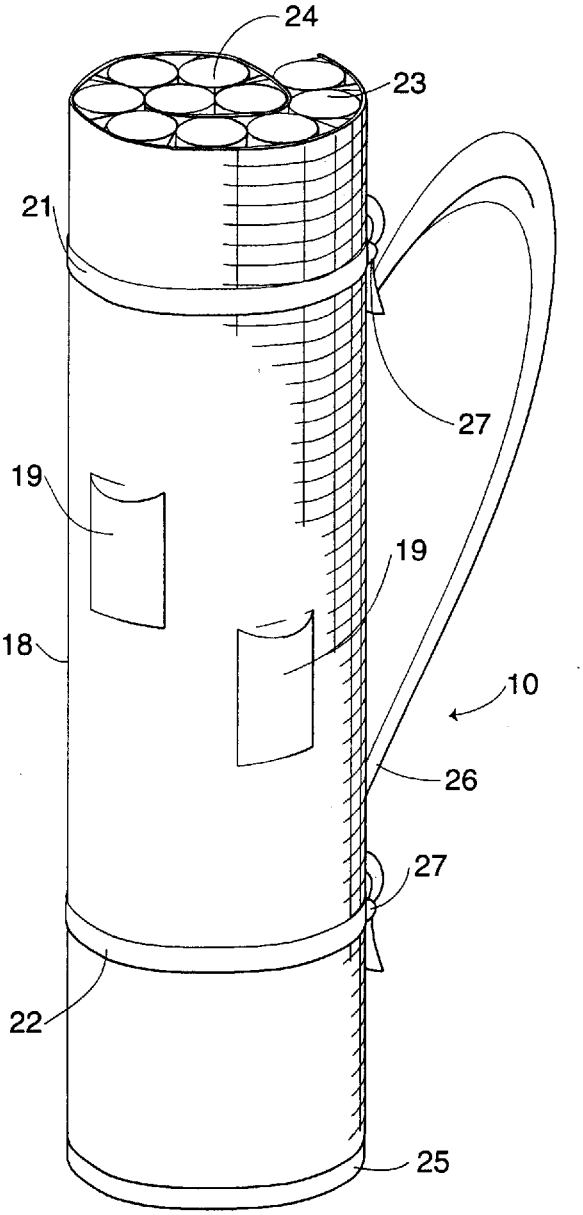
FIG. 2 is a side view of the convertible carrier of this invention, shown in a closed position with a carrying strap.

The carrier 10 of this invention can be equipped with other functional features. Examples of such features are a carrying strap 14 as shown in FIG. 2 and pockets for golf balls, tees, shoes and other golf-related equipment. FIG. 2 shows a base member 18 having two pockets 19 which are conventionally attached to the base member 18.

Figure 3:
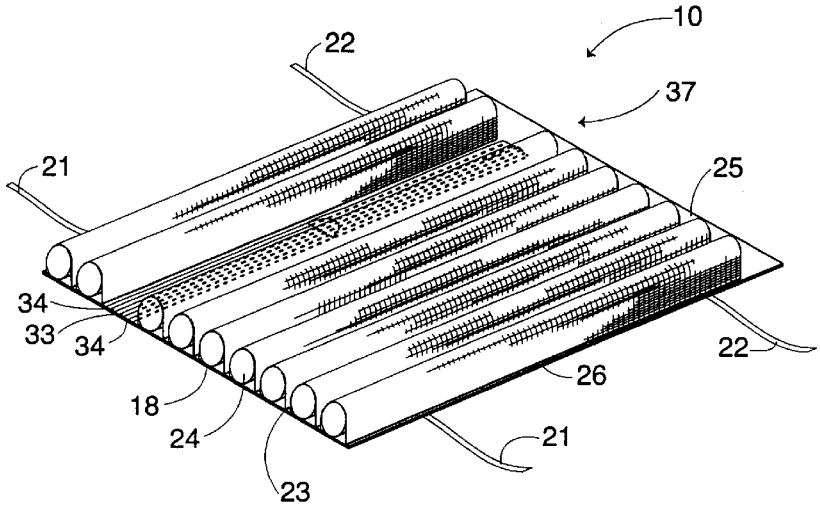
FIG. 3 is a top view of the convertible carrier of this invention, shown in a substantially flat open position.

The carrier 10 of this invention is shown in a substantially flat open position in FIG. 3. Also shown in FIG. 3 is the spaced apart relationship of the discrete elongated tubular members 23. As shown in the cut-away portion of FIG. 3, a hook-and-loop attachment 37 comprising matingly engageable top sheet 33 and bottom sheet 34 secure the tubular member 23 to the base member 18. The bottom sheet 34 attaches conventionally to the base member 18, and the top sheet 33 attaches conventionally to the tubular member 23. The opposing surfaces of the top sheet 33 and bottom sheet 34 define matingly engageable surfaces as would be in a conventional hook-and-loop closure. As shown, the bottom sheet 34 is wider than the top sheet 33.

Figure 4:
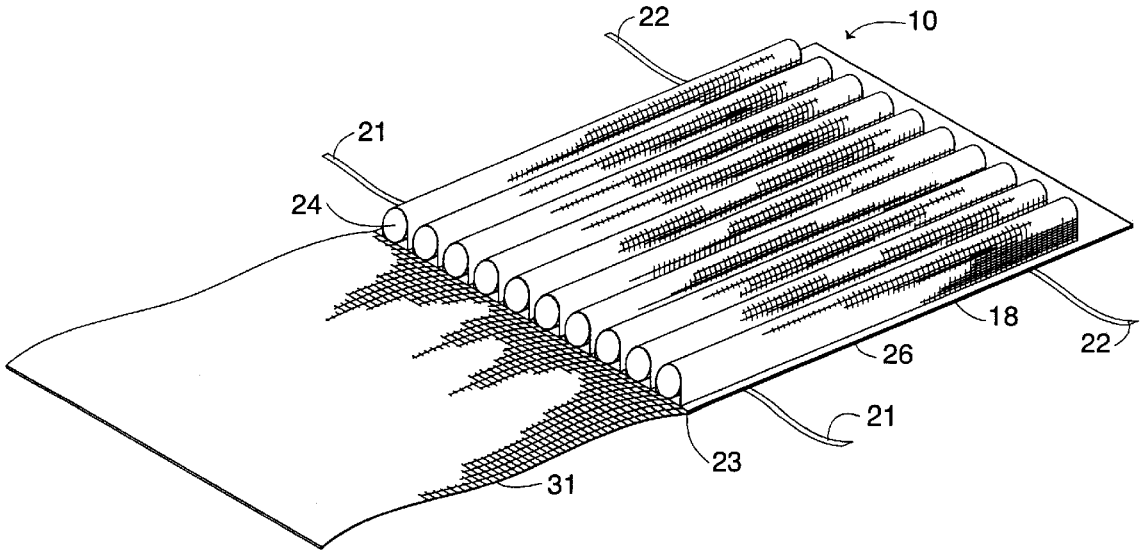
FIG. 4 is a top view of the convertible carrier of this invention, shown in a substantially flat open position with a cover.

Another embodiment of this invention is shown in FIG. 4, in which the carrier 10 is shown in a substantially flat open position and equipped with a cover 31 for increased protection of the golf clubs or other contents.

When folded or closed, the carrier 10 of this invention will form a tubular bundle, as shown in FIGS. 1 and 2. As also shown in these Figures, the bottom portion of each tubular member 23 is closed to prevent the golf clubs from falling out of the carrier and to protect the grips, shafts and heads of the golf clubs.

When playing golf, the carrier of this invention is generally used in the closed position, but the carrier readily "converts" to a substantially flat open position for storage in a car trunk during travel. In the substantially flat open position, two or more carriers can be stacked on top of each other.

This invention has been described in detail with particular reference to certain embodiments, but variations and modifications can be made without departing from the spirit and scope of the invention as defined in the following claims.

What is claimed is:

1. A convertible carrier for golf clubs, wherein the carrier comprises:

A. a base member having a top portion, an elongated middle portion and a bottom portion;

B. a plurality of discrete elongated tubular members, each tubular member having top, middle and bottom portions and having a length substantially equal to the length of the base member, wherein the top portion of each tubular member is open and the bottom portion of each tubular member is closed, and wherein each tubular member is attached to the base member at a spaced apart interval from other tubular members; and C. closing means attached to the base member.

2. A carrier as defined by claim 1, wherein the base member is made from a fabric material.

3. A carrier as defined by claim 1, wherein the base member is made from a ballistic nylon material.

4. A carrier as defined by claim 1, wherein each tubular member is made from a fabric material.

5. A carrier as defined by claim 1, wherein each tubular member is made from a ballistic nylon material.

6. A carrier as defined by claim 1, wherein a rigid structural liner is inserted into one or more tubular members.

7. A carrier as defined by claim 6, wherein the liner is made from a rigid vinyl material.

8. A carrier as defined by claim 1, wherein each tubular member is attached to the base member by a sewn attachment.

9. A carrier as defined by claim 1, wherein each tubular member is attached to the base member by a hook-and-loop attachment.

10. A carrier as defined by claim 1, wherein the base member includes one or more pockets.

11. A carrier as defined by claim 1, wherein the carrier has an attached carrying strap.

12. A carrier as defined by claim 1, wherein the carrier has an attached cover.

* * * * *